US006441562B1

(12) United States Patent
Kim

(10) Patent No.: US 6,441,562 B1
(45) Date of Patent: Aug. 27, 2002

(54) DRIVING APPARATUS OF A FLAT PANEL DISPLAY

(75) Inventor: Jong-Seon Kim, Kyungki-do (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/804,063

(22) Filed: Mar. 13, 2001

(30) Foreign Application Priority Data

Mar. 13, 2000 (KR) ..... 2000-12416

(51) Int. Cl.[7] ..... G06G 3/10

(52) U.S. Cl. ..... 315/169.3; 315/169.2; 315/169.1; 345/698; 345/214; 345/212

(58) Field of Search ..... 315/169.3, 169.2, 315/169.1, 224, 360; 345/698, 212, 214, 100

(56) References Cited

U.S. PATENT DOCUMENTS 5,434,599 A * 7/1995 Hirai et al. ..... 345/100
5,598,180 A * 1/1997 Suzuki et al. ..... 345/100
5,900,856 A * 5/1999 Iino et al. ..... 345/100
6,072,457 A * 6/2000 Hashimoto et al. ..... 345/100

* cited by examiner

*Primary Examiner*—Haissa Philogene
(74) *Attorney, Agent, or Firm*—McGuireWoods LLP; Hae-Chan Park

(57) ABSTRACT

Disclosed is a driving apparatus of a flat panel display. The apparatus comprises a signal processing device for outputting display data, gray scale voltages, a gate On/Off voltage, a source control signal and a gate control signal with a driving data, a driving control signal, and a driving power source; a main source driver IC for generating and outputting a source signal; a main gate driver IC for generating and outputting a gate signal; a display panel for displaying an image; a source feedback unit arranged along a row direction of the display panel that is opposite said main source driver IC, for detecting distorted amount of a source signal output from a pixel placed at the last row of a source line connected to the main source driver IC and feeding back a first compensation signal corresponding to the distorted amount of the source signal to the pixel at the last column; and a gate feedback unit arranged along a column direction of the display panel that is opposite said main gate driver IC, for detecting distorted amount of a gate signal output from a pixel placed at the last column of a gate line connected to the main gate driver IC and feeding back a second compensation signal corresponding to the distorted amount of the gate signal to the pixel at the last row.

7 Claims, 4 Drawing Sheets

DRIVING APPARATUS OF A FLAT PANEL DISPLAY

BACKGROUND OF THE INVENTION

1. Field of the Invention

The present invention relates to a driving apparatus of a flat panel display, and more specifically, to a driving apparatus of a flat panel display having sub gate driver IC and sub source driver IC that compensate for distortion of the source and gate signals caused by transmission delay of the source and gate signals in flat panel display of a large size.

2. Description of the Related Art

Recently, flat panel displays such as liquid crystal display (LCD), plasma panel display, electroluminescence display panel take advantages of the smaller dimension, lighter weight and lower power consumption, and replace a traditional cathode ray tube(CRT).

Generally, driving signals for driving flat panel displays are supplied in a form of voltage or current that is proportional or inversely proportional to the brightness of the pixel unlike the operation method of CRT. The driving signals act as changing the panel electrically or optically. The driving signals are supplied from driving apparatus arranged adjacent to the panel.

Flat panel displays need the driving signals to be supplied without a signal distortion over the entire display area. To this end, various kinds of items should be considered in designing and processing the panel.

By continuous research and development in design and process technologies, many needs have been met step by step. However, in a flat panel display having a large screen, it is difficult to obtain a high definition and high quality in picture because of signal distortions caused by the time delay of transmission signals.

To overcome the drawback, a method for lowering the resistance of wires formed on the panel, for minimizing load by stray capacitance and decreasing load of adjacent circuits is provided.

The method, however, does not satisfy a desired requirement for wire resistance because of the limitations in the currently used material and process technology. Also, development of new material capable of satisfying the desired condition needs more time and may require new process equipments for the newly developed material. Moreover, the structural limitation of pixel makes it also difficult to decrease the stray capacitance below a critical value.

Thus, it is required to prevent picture quality degradation as the screen size of the flat panel display increases.

SUMMARY OF THE INVENTION

Accordingly, it is an object of the present invention to obtain high quality of image over the entire screen area of a flat panel display of a large size screen.

It is another object of the present invention to compensate for distortion of driving signals during the signal transmission.

To achieve the above and other objects and advantages, there is provided a driving apparatus of a flat panel display comprising: a signal processing means for outputting a plurality of signals including display data, gray scale voltages, a gate On/Off voltage, a source control signal and a gate control signal with a driving data, a driving control signal, and a driving power source; a main source driver IC for generating and outputting a source signal using the display data, the gray scale voltages and the source control signal; a main gate driver IC for generating and outputting a gate signal using the gate On/Off signal and the gate control signal; a display panel having a plurality of pixels configured in a matrix arrangement, for displaying an image by selectively driving the pixels; a source feedback means arranged along a row direction of the display panel that is opposite said main source driver IC, for detecting distorted amount of a source signal output from a pixel placed at the last column of a source line connected to the main source driver IC and feeding back a first compensation signal corresponding to the distorted amount of the source signal to the pixel at the last column; and a gate feedback means arranged along a column direction of the display panel that is opposite said main gate driver IC, for detecting distorted amount of a gate signal output from a pixel placed at the last row of a gate line connected to the main gate driver IC and feeding back a second compensation signal corresponding to the distorted amount of the gate signal to the pixel at the last row.

It is desirous that the source feedback means comprises a plurality of sub-source driver ICs, each of said sub-source driver ICs having a plurality of first basic unit elements, each of said first basic unit blocks comprising: a first mixer for mixing source signal output from the last pixel placed at the last column of source signal transmission with the first compensation signal; a first differential circuit for differentiating an output of said first mixer; a first adder for adding the output of said first mixer and an output of said first differential circuit; and a first amplifier for amplifying an output of said first adder to a predetermined level and applying the amplified signal to the first mixer as said first compensation signal.

It is desirous that the first basic unit block further comprises: a first subtracter for comparing the output of said first adder with the output of said first mixer and outputting a difference signal corresponding to a difference between the output of said first adder and the output of said first mixer; and a first gain control part for controlling the outputs of said first differential circuit and said first adder with the output of said first subtracter, wherein the basic unit block restrains an oscillation generated from a first feedback loop consisting of said first differential circuit, said first adder and said first amplifier.

BRIEF DESCRIPTION OF THE DRAWINGS

The above objects and other advantages of the present invention will become more apparent by describing in detail a preferred embodiment thereof with reference to the attached drawings in which.

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein.

In the constitution of the present invention, main source and gate driver ICs(Integrated circuit) that output driving signals of source signal and gate signal for driving a flat panel display is arranged symmetrically with sub source and gate driver ICs that compensate for distorted driving signals by a feedback operation at the source side and the gate side, respectively.

Figure 1:
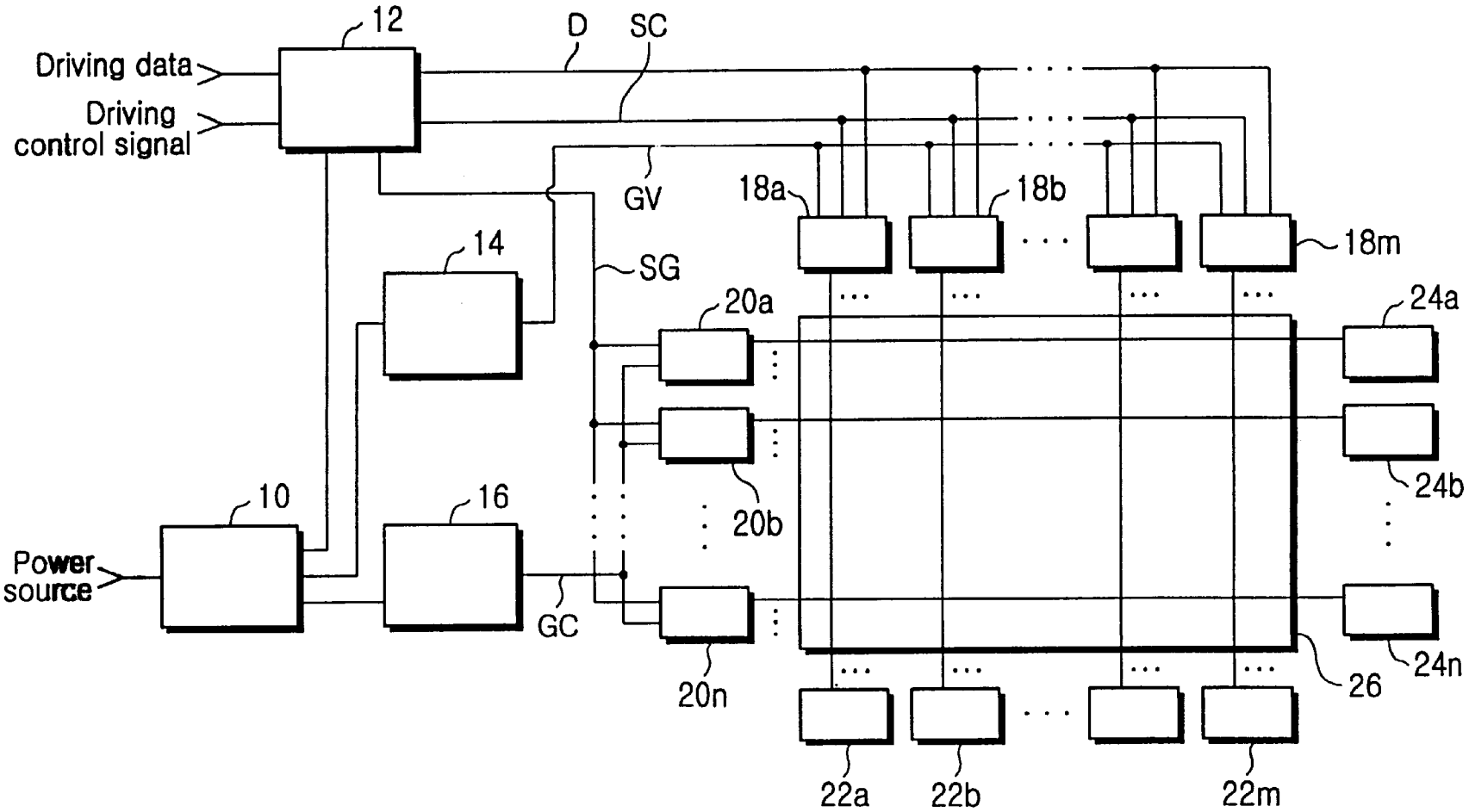
FIG. 1 is a block diagram of driving apparatus of a flat panel display according to the present invention.

The present invention is preferably applied to LCDs and FIG. 1 shows an example of such a driving apparatus applied to an LCD.

Referring to FIG. 1, the driving apparatus comprises a driving power source 10 that generates a static voltage necessary for operating all elements of the LCD and outputs the static voltage to a timing controller 12, a gray scale generating part 14 and a gate on/off voltage generating part 16.

The timing controller 12 generates a plurality of data signals "D" corresponding to R, G, B and a source control signal of "SC", controls timings of the the source control signals data and signals, and then applies the data and signals to a main source driver ICs 18*a*, 18*b*, . . . , 18*m*. Simultaneously, the timing controller 12 generates a gate control signal of "SG" to control timing of the generated gate control signal with the source side, and then applies the signal of "SG" to a main gate driver ICs 20*a*, 20*b*, . . . , 20*n*.

The gray scale generating part 14 generates gray scale voltages of "GV" by a number corresponding to a value of data signal "D" and applies the generated gray scale voltages to respective main source driver ICs 18*a*, 18*b*, . . . , 18*m*.

The gate on/off voltage generating part 16 applies gate turning-on voltage and gate turning-off voltage to respective main gate driver ICs 20*a*, 20*b*, . . . , 20*n*.

Each of the main source driver ICs 18*a*, 18*b*, . . . , 18*m* decides an output level of gray scale voltage of "GV" to be output using the data signal "D" and source control signal "SC" and allows the decided gray scale voltage to be output to a display panel as source signal.

Each of the main gate driver ICs 20*a*, 20*b*, . . . , 20*n* outputs a gate signal for turning on/off a corresponding pixel of the display panel using the gate control signal of "SG" and the gate on/off signal of "GC".

The LCD panel displays images on the panel screen with the source signal supplied from the main source driver ICs 18*a*, 18*b*, . . . , 18*m* and the gate signal supplied from the main gate driver ICs 20*a*, 20*b*, . . . , 20*n*.

Sub-source driver ICs 22*a*, 22*b*, . . . , 22*m* are arranged along a horizontal edge(row direction) of the display panel 26 opposite the main source driver ICs 18*a*, 18*b*, . . . , 18*m* and sub-gate driver ICs 24*a*, 24*b*, . . . , 24*n* are arranged along a vertical edge(column direction) of the display panel 26 opposite the main gate driver ICs 20*a*, 20*b*, . . . , 20*n*. Each of the sub-source driver ICs 22*a*, 22*b*, . . . , 22*m* is electrically connected to each of the main source driver ICs 18*a*,18*b*, . . . , 18*m* and each of sub-gate driver ICs 24*a*, 24*b*, . . . , 24*n* is electrically connected to each of the main gate driver ICs 20*a*, 20*b*, . . . , 20*n*.

The number of sub-source driver ICs 22*a*, 22*b*, . . . , 22*m* equals to the number of the main source driver ICs 18*a*, 18*b*, . . . , 18*m* and a selected port of each of the sub-source driver ICs 22*a*, 22*b*, . . . , 22*m* and a port of each of the main source driver ICs 18*a*, 18*b*, . . . , 18*m* corresponding to the selected port of each of the sub-source driver ICs 22*a*, 22*b*, . . . , 22*m* is commonly connected to a corresponding source line. Likewise, the number of sub-gate driver ICs 24*a*, 24*b*, . . . , 24*n* equals to the number of the main gate driver ICs 20*a*, 20*b*, . . . , 20*n*, and a selected port of each of the sub-gate driver ICs 24*a*, 24*b*, . . . , 24*n* and a port of each of the main gate driver ICs 20*a*, 20*b*, . . . , 20*n* corresponding to the selected port of each of the sub-gate driver ICs 24*a*, 24*b*, . . . , 24*n* is commonly connected to a corresponding gate line.

In other words, the main source driver ICs 18*a*, 18*b*, . . . , 18*m* are symmetrically arranged with the sub source driver ICs 22*a*, 22*b*, . . . , 22*m* and the main gate driver ICs 20*a*, 20*b*, . . . , 20*n* are symmetrically arranged with the sub gate driver ICs 24*a*, 24*b*, . . . , 24*n*.

Figure 2:
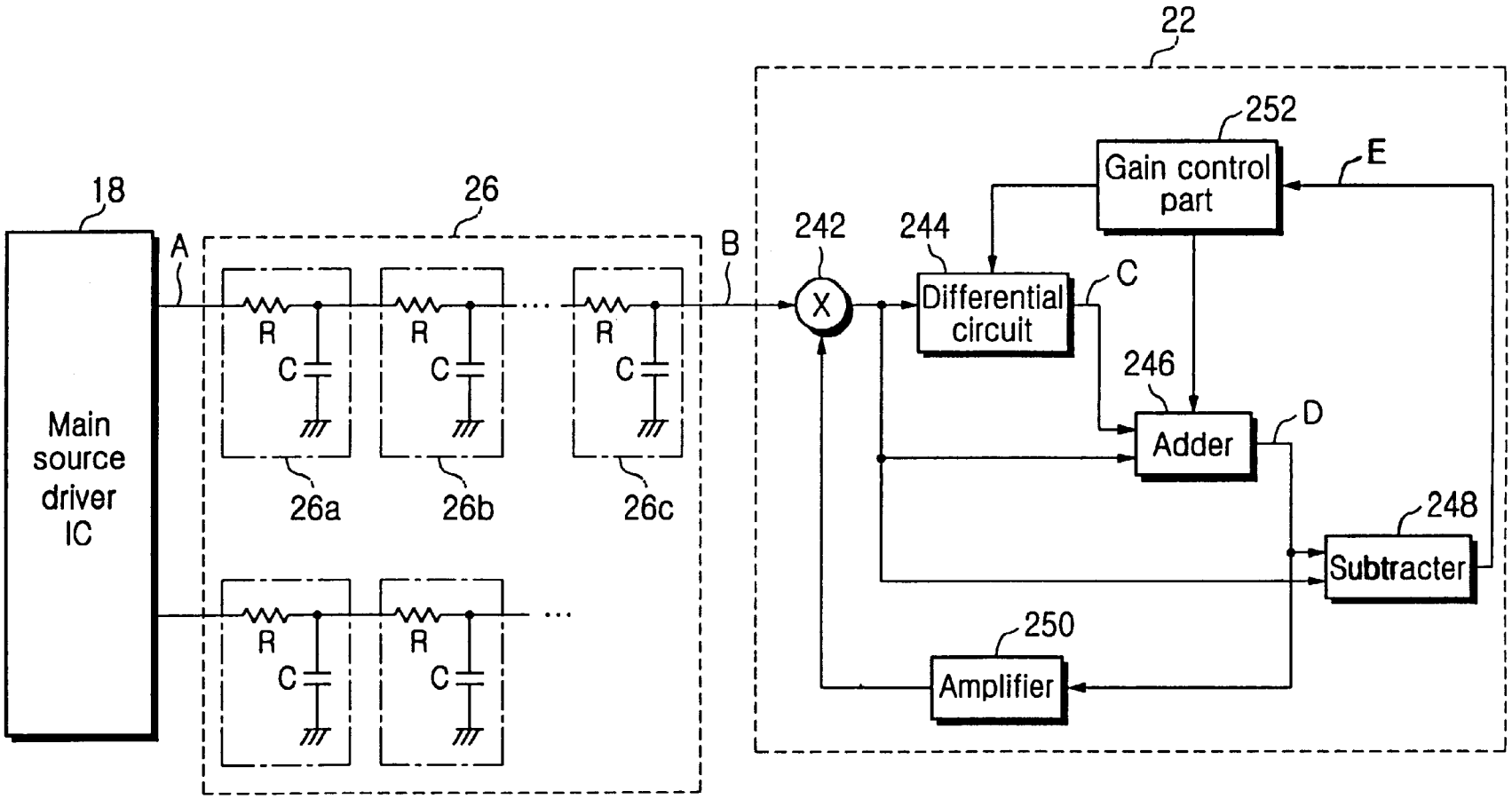
FIG. 2 is a detailed view of FIG. 1.

FIG. 2 is a circuit diagram illustrating a detailed relationship between the main source driver ICs 18*a*, 18*b*, . . . , 18*m* and the sub-source driver ICs 22*a*, 22*b*, . . . , 22*m*. Although not shown in the drawings, a constitution between the main gate driver ICs 20*a*, 20*b*, . . . , 20*n* and the sub-gate driver ICs 24*a*, 24*b*, . . . , 24*n* is also the same. For the convenience of the description, hereinafter the main source driver ICs are referred to as reference numeral "18" and the sub source driver ICs are referred to as reference numeral "22".

Each of the pixels with the matrix arrangement in the display panel 26, that is, unit pixel comprises a resistor "R" and a capacitor "C". In FIG. 2, unit pixels 26*a*, 26*b*, 26*c* are those that are connected to the same source line.

The sub source driver IC 22 has a plurality of basic unit blocks, and each of the basic unit blocks comprises a mixer 242 into which an output of the display panel 26 is input, a differential circuit 244 into which an output of the mixer 242 is input, an adder 246 into which an output of the differential circuit 244 and an output of the mixer 242 are input, a subtracter 248 into which an output of the adder 246 and an output of the mixer 242 are input, an amplifier 250 for amplifying an output of the adder 246, and a gain control part 252 into which an output of the substracter 248 is input and provides the differential circuit 244 and the adder 246 with a first gain control signal and a second gain control signal, respectively.

Hereinafter, operation of the driving apparatus with the above described constitution is described with reference to the accompanying drawings.

First, image displaying procedure is described.

Driving data and driving control signals are input from image supply source, for instance, main board of a computer to the timing controller 12. Driving data contain R, G, B data for the formation of image and driving control signals contain vertical synchronous signal, horizontal synchronous signal, and data enable signal.

Referring to FIG. 1, the timing controller 12 applies data signal "D" corresponding to R, G, B data and source control signal "SC" to the main source driver ICs 18*a*, 18*b*, . . . , 18*m* as the driving data and the driving control signal, and the gray scale generating part 14 supplies gray scale voltages to the main source driver ICs 18*a*, 18*b*, . . . , 18*m*.

Then, the main source driver ICs 18*a*, 18*b*, . . . , 18*m* outputs source signals corresponding to the data signal "D" in which the source signal is timing controlled to be matched with the turn-on period of the gate signal output from the main gate driver ICs 20*a*, 20*b*, . . . , 20*n* in a single horizontal period unit.

Also, the timing controller 12 applies the gate control signal "SG" to the main gate driver ICs 20*a*, 20*b*, . . . , 20*n*, respectively. The gate on/off voltage generating part 16 applies the gate on/off voltages to the main gate driver ICs 20*a*, 20*b*, . . . , 20*n*, respectively. Then, the main gate driver ICs 20*a*, 20*b*, . . . , 20*n* sequentially outputs the gate on/off signals to the gate lines of the display panel 26.

As thin film transistors in respective pixels are turned on by applying the gate-on signal to the gate terminal of the thin film transistor, the source signal is transmitted into the liquid crystal via the source terminal and the drain terminal of the thin film transistor. As a result, corresponding pixels are charged. The pixel is charged by sequentially scanning pixels in a first column and thereafter scanning pixels in a next column. After an image corresponding to one frame is formed, source signal and gate signal for the next frame are applied.

Then, as the distance between the main source driver IC and pixel increases, the source signal is delayed due to the resistance of the pixel and capacitance of the liquid crystal. And, as the distance between the main gate driver IC and pixel increases, the gate signal is also delayed due to the resistance of the pixel and the capacitance of the liquid crystal.

Figures 3A, 3B, 3C, 3D, 3E:
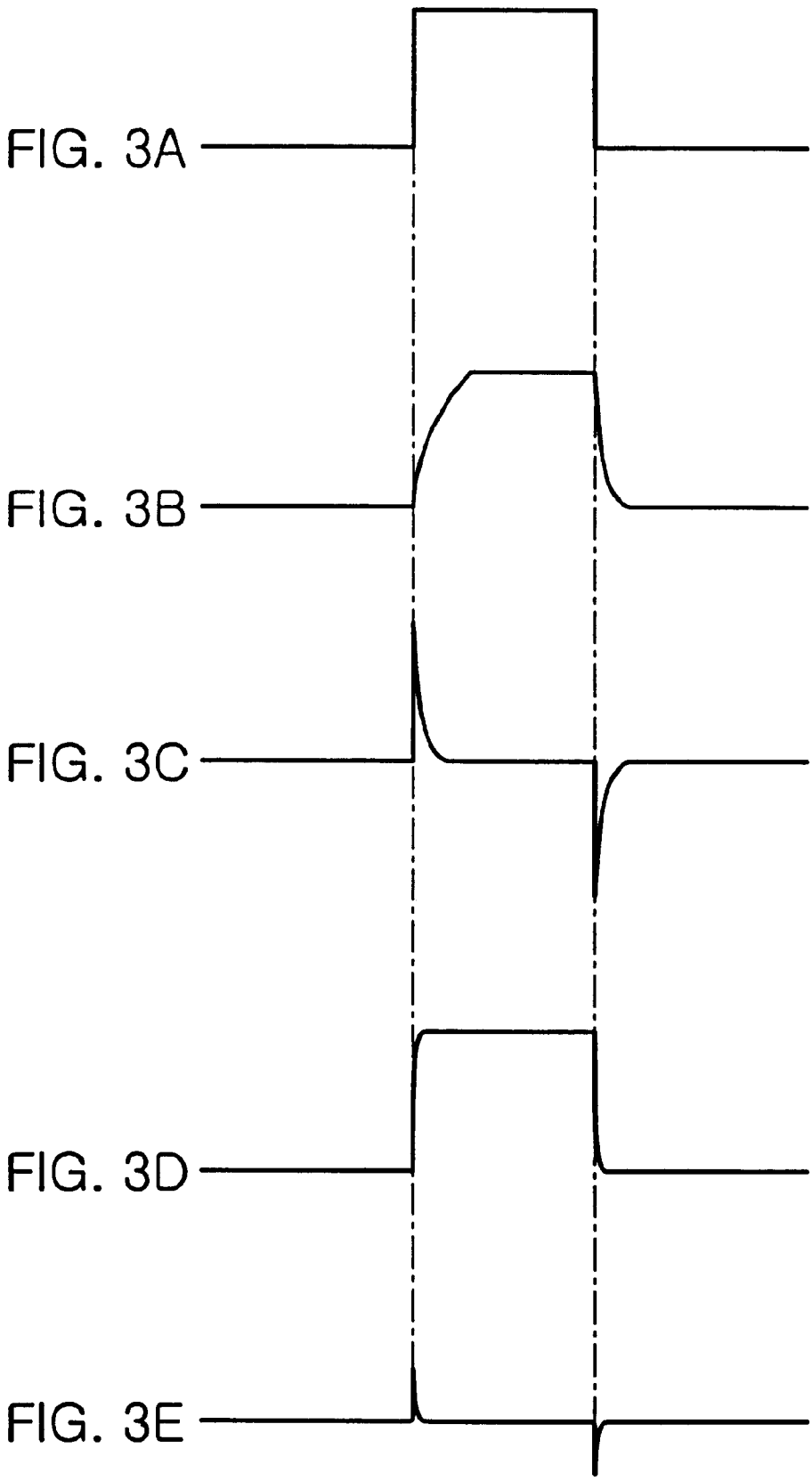
FIGS. 3A through 3E are waveforms illustrating an operation of the apparatus of FIG. 2.

Specifically, as shown in FIG. 2, the source signal "A" output from the main source driver IC 18 has an ideal waveform as shown in FIG. 3A. The source signal "A" is gradually delayed as it sequentially goes to the pixels connected to one source line. As a result, the source signal "B" passing through the last pixel placed at the last column of a selected row has a distorted waveform as shown in FIG. 3B. Thus, since distorted source signal causes insufficient charging of pixel, it becomes difficult to obtain an image with a desired brightness. To this end, the sub source driver IC 22 applies a compensation signal to the pixels connected to the source line in reverse direction.

Hereinafter, compensation method using the feedback loop is specifically described.

For reference, an output "C" of the differential circuit 244 has a waveform as shown in FIG. 3C, an output "D" of the adder 246 has a waveform as shown in FIG. 3D, and an output "E" of the subtracter 248 has a waveform as shown in FIG. 3E.

After the source signal is applied to the last pixel 26*c* of the selected row, the source signal is input into the differential circuit 244 through the mixer 242. The differential circuit 244 differentiates the source signal input through the mixer 242 and then outputs the differentiated resultant signal having the waveform of FIG. 3C to the adder 246. The differential circuit 244 is provided for the purpose of compensating for loss due to the distorted source signal of FIG. 3B. In other words, the output waveform of the differential circuit 244 shown in FIG. 3C has a shape to compensate for the loss of the waveform shown in FIG. 3B.

The output signal of the mixer 242 and the output signal of the differential circuit 244 are added at the adder 246. The added signal has a waveform shown in FIG. 3D, which is a shape similar to the shape of the waveform of the output signal "A" of the main source driver IC 18. The output signal of the adder 246 with the waveform of FIG. 3D is applied to the amplifier 250 and is amplified to a predetermined level by the amplifier 250. The amplified output signal of the amplifier 250 is thereafter feedback to the mixer 242.

The feedback signal that is fedback through the above described feedback loop is transmitted to the main source driver IC 18. That is, the feedback signal is transmitted in the reverse direction of the transmission path of the source signal. Thereby, the distorted signals of respective pixels are compensated to the same level by the feedback signal.

Thus, the present invention compensates for the signal distortion using the feedback loop comprising the differential circuit 244, the adder 246 and the amplifier 250.

Figure 4:
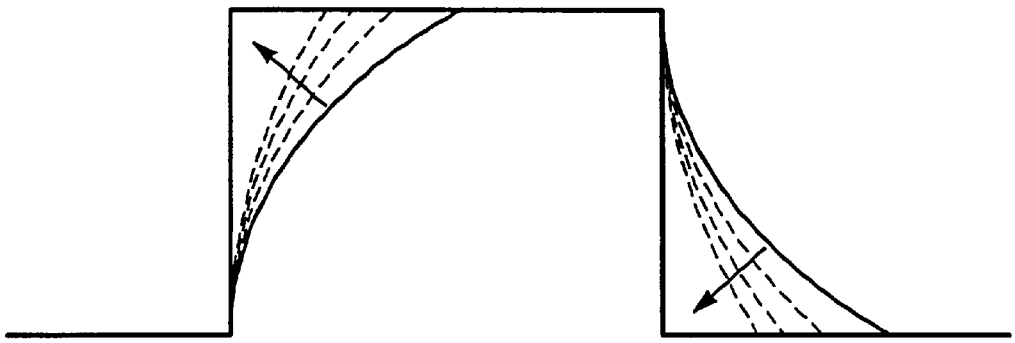
FIG. 4 is a waveform illustrating a charged state of data signal.

In other words, as shown in FIG. 4, the distorted signals are compensated along the arrow directions and thereby are recovered to the square wave.

Meanwhile, gains of the output signals of the differential circuit 244 and the adder 246 should be controlled considering the oscillation of the compensation signal through the feedback loop. To this end, the gain control part 252 and the subtracter 248 are also provided in the sub source driver IC 22.

The subtracter 248 compares the output of the adder 246 with the output of the mixer 242 and obtain a difference signal corresponding to the difference between the output of the adder 246 and the output of the mixer 242 as shown in FIG. 3E. The gain control part 252 outputs first and second gain control signals that are proportional to the current value of the signal input from the subtracter 248 to the differential circuit 244 and the adder 246, respectively. The output levels of the differential circuit 244 and the adder 246 are controlled by the first and second gain control signals. As a result, the oscillation by the feedback loop operation is restrained by the operation of the subtracter 248 and the gain control part 252.

Thus, since normal source signals having the square wave of FIG. 3A are provided to respective pixels and thereby charged amount of the liquid crystal is proportional to the brightness of the gray scale for displaying an original image, an image having uniform brightness over the entire panel area is obtained.

Meanwhile, although FIG. 2 shows and describes a basic unit block comprising the mixer 242, the differential circuit 244, the adder 246, the subtracter 248, the amplifier 250, and the gain control part 252 that are necessary for a single source line, a single sub source driver IC has a plurality of basic unit blocks corresponding to the number of the source lines connected to the single sub source driver IC.

Moreover, although only the constitution of the sub source driver IC and the operation between the main source driver IC and the sub source driver IC are described, the sub gate driver IC has the same constitution as that of the sub source driver IC and the operation between the main gate driver IC and the sub gate driver IC can be also described in the same manner as the operation between the main source driver IC and the sub source driver IC. Accordingly, the operation between the main gate driver IC and the sub gate driver IC is intentionally omitted.

As aforementioned, in a driving apparatus of flat panel display according to the present invention, the sub source driver IC and the sub gate driver IC compensate for losses due to the distortion of source and gate signals applied to respective pixels to obtain a desired image with uniform brightness. Moreover, when the invention is applied to a flat panel display of a large size screen, it is more effective.

This invention has been described above with reference to the aforementioned embodiments. It is evident, however, that many alternatives, modifications and variations will be apparent to those having skills in the art in light of the foregoing description. Accordingly, it is intended to embrace all such alternatives, modifications and variations as fall within the spirit and scope of the appended claims.

What is claimed is:

1. A driving apparatus of a flat panel display comprising:

a signal processor for outputting a plurality of signals including data signal, gray scale voltages, a gate On/Off voltage, a source control signal and a gate control signal;

a main source driver IC for generating a source signal using the display data, the gray scale voltages and the source control signal;

a main gate driver IC for generating a gate signal using the gate On/Off signal and the gate control signal;

a display panel having a plurality of pixels configured in a matrix, for displaying an image by selectively driving the pixels;

a source feedback device arranged along a row direction of the display panel that is opposite said main source driver IC, for detecting distorted amount of a source signal output from a pixel placed at the last row of a source line connected to the main source driver IC and feeding back a first compensation signal corresponding to the distorted amount of the source signal to the pixel at the last row; and a gate feedback device arranged along a column direction of the display panel that is opposite said main gate driver IC, for detecting distorted amount of a gate signal output from a pixel placed at the last column of a gate line connected to the main gate driver IC and feeding back a second compensation signal corresponding to the distorted amount of the gate signal to the pixel at the last column.

2. The driving apparatus of claim 1, wherein said source feedback device comprises a plurality of sub-source driver ICs, each of the sub-source driver ICs having a plurality of first basic unit blocks, each of the first basic unit blocks comprising:

a first mixer for mixing source signal output from the last pixel placed at the last row of source signal transmission with the first compensation signal;

a first differential circuit for differentiating an output of said first mixer;

a first adder for adding the output of said first mixer and an output of said first differential circuit; and a first amplifier for amplifying an output of said first adder to a predetermined level and applying the amplified signal to the first mixer as the first compensation signal.

3. The driving apparatus of claim 2, wherein the first basic unit block further comprises:

a first subtracter for comparing the output of said first adder with the output of said first mixer and outputting a difference signal corresponding to a difference between the output of said first adder and the output of said first mixer; and a first gain control part for controlling the outputs of said first differential circuit and said first adder with the output of said first subtracter, wherein the first basic unit block restrains an oscillation generated from a first feedback loop consisting of said first differential circuit, said first adder and said first amplifier.

4. The driving apparatus of claim 2, wherein the sub-source driver IC comprises a number of columns that equal to the number of columns corresponding to said main source driver IC.

5. The driving apparatus of claim 1, wherein the gate feedback device comprises a plurality of sub-gate driver ICs, each of the sub-gate driver ICs having a plurality of second basic unit blocks, each of the second basic unit blocks comprising:

a second mixer for mixing gate signal output from the last pixel placed at the last column of gate signal transmission path with the second compensation signal;

a second differential circuit for differentiating an output of said second mixer;

a second adder for adding the output of said second mixer and an output of said second differential circuit; and a second amplifier for amplifying an output of said second adder to a predetermined level and applying the amplified signal to the mixer as the second compensation signal.

6. The driving apparatus of claim 5, wherein the second basic unit block further comprises:

a second subtracter for comparing the output of said second adder with the output of said second mixer and outputting a difference signal corresponding to a difference between the output of said second adder and the output of said second mixer; and a second gain control part for controlling the outputs of said second differential circuit and said first adder with the output of said first subtracter, wherein the second basic unit block restrains an oscillation generated from a second feedback loop consisting of said second differential circuit, said second adder and said second amplifier.

7. The driving apparatus of claim 5, wherein the sub-gate driver IC comprises a number of rows that equal to the number of rows corresponding to said main gate driver IC.

* * * * *